US006318285B1

(12) United States Patent
Hartlmeier et al.

(10) Patent No.: US 6,318,285 B1
(45) Date of Patent: Nov. 20, 2001

(54) FURLING SAIL SYSTEM

(75) Inventors: Greg Hartlmeier, Whitefish Bay, WI (US); Thomas Omohundro, Minden, NV (US)

(73) Assignee: Harken, Inc., Pewaukee, WI (US)

( * ) Notice: Subject to any disclaimer, the term of this patent is extended or adjusted under 35 U.S.C. 154(b) by 0 days.

(21) Appl. No.: 09/665,144

(22) Filed: Sep. 19, 2000

(51) Int. Cl.[7] ..... B63H 9/04

(52) U.S. Cl. ..... 114/106; 114/108

(58) Field of Search ..... 114/102.1, 102.15, 114/102.19, 102.21, 104, 105, 106, 107, 108

(56) References Cited

U.S. PATENT DOCUMENTS

| | | | | |
|---|---|---|---|---|
| 3,938,460 | * | 2/1976 | Wales et al. | 114/106 |
| 4,487,148 | * | 12/1984 | Umeda | 114/106 |
| 4,723,499 | * | 2/1988 | Furgang | 114/106 |

* cited by examiner

*Primary Examiner*—Jesus D. Sotelo
(74) *Attorney, Agent, or Firm*—Pyle & Piontek

(57) ABSTRACT

A furling sail system for rotatably dispensing and retrieving a furling sail has a rotating swivel and drum for attachment to the sail. Each of the drum and swivel have a body with a perimeter, with cordage attachment means on the body for attaching the furling sail with a length of cordage. The cordage attachment means have a pair of cooperating passages for guiding a length of cordage about at least 40% of the respective body perimeter.

24 Claims, 5 Drawing Sheets

FURLING SAIL SYSTEM

FIELD OF THE INVENTION

The present invention is related to furling systems for attaching to sails on sailing vessels. In particular, the present invention is related to furling systems used to rotatably attach to a furling sail.

BACKGROUND OF THE INVENTION

Furling sails are known in the art. They are generally a jib that may be wrapped about a stay for storage when not in use. The wrapping of the furling sail allows the sail to be easily stored and deployed. As illustrated in FIG. 1, a furling sail 6 is typically attached at its base to furling drum 4, which may be wound and unwound using an attached rope 8 to deploy and retract sail 6 (illustrated as partially unwound). The head of the furling sail is attached to a support such as the sailboat masthead 10 using swivel 2, while the tack of the sail is attached to the rotating furling drum 4. The swivel 2 and drum are connected to one another by foil 12, which rotatably rides over a headstay. The swivel 2 generally has a top body element that is attached to the masthead, and a lower body element attached to the furling sail head and that rotates with the drum 4 as the furling sail is wound and unwound around the foil 12.

Further detail regarding furling systems and furling swivels of the prior art is available in the 1999 products catalogue of Harken Inc., Pewuakee Wis., USA; incorporated herein by reference. In particular, attention is drawn to furling systems comprising drums and swivels illustrated on pages 115–129 of the catalogue.

A number of heretofore unresolved problems exist with furling systems. The furling sail swivel and drum must anchor a sail that may be under very heavy wind loads. Additionally, the swivel and drum must withstand severe weather conditions. With these considerations in mind, furling swivels and drums are generally of relatively robust and heavy construction. The swivel and drum typically have an extended tang with an eyelet through which a stainless steel linkage piece such as a clasp or bracket connects to the sail. The relatively heavy construction of the tang and brackets used to attach the sail head and tack are disadvantageous for sailing vessels, as there is a desire to keep weight to a minimum. Further, the swivel is located at the top of the furling sail high up in the rigging of a sailing vessel. This compounds the effects of its relatively heavy weight, as weight high aloft is particularly disadvantageous because it increases heeling of the boat.

The clasps or brackets used to attach the sail head and tack may disadvantageously deform or even fail through fatigue. This results from the stresses sails are under in combination with the extreme weather conditions the clasps or brackets are exposed to.

An additional unresolved problem with furling sail swivels and drums relates to their wind drag characteristics. It is desirable for sailing vessels to have minimal wind drag, particularly aloft. The extended tang on the furling system drum and swivel result in disadvantageous wind drag characteristics.

The tang and bracket used to attach the sail to the swivel and to the drum are also disadvantageous for reasons in addition to weight and wind drag. In particular, the length of the tang increases the bending moment on the swivel and drum. Also, the tang concentrates the bending stress on a small portion of the swivel or drum. As the drum or swivel rotates, this increased and concentrated bending moment is passed on to a small portion of the bearings or other rotation facilitating means used by the drum or swivel. This disadvantageously increases frictional resistance to rotation of the drum or swivel, as well as decreasing the service life of the bearings.

An unresolved need therefore exists for an improved furling sail system.

OBJECTS OF THE INVENTION

It is an object of the present invention to provide a furling sail system of lightweight construction.

It is a further object of the invention to provide a furling sail system having an advantageous wind drag profile.

It is a further object of the invention to provide a furling sail system having a minimal bending moment on rotating bearing means.

It is a further object of the present invention to provide a method for attaching a furling sail to a furling system.

SUMMARY OF THE INVENTION

The furling sail system of the present invention generally comprises at least one rotating member for attachment to a sail, the rotating member having a perimeter, with the rotating member further having cordage attachment means for guiding a length of cordage about at least a portion of the perimeter of the rotating member, the cordage for attaching a sail. Preferably, the cordage attachment means comprise at least one channel through which the length of cordage may be passed. More preferably, the attachment means comprise a pair of channels. The pair of channels cooperate with one another whereby the rope may be passed from one channel, over a portion of the rotating member perimeter, and through the other of the pair of channels. Preferably, the cordage attachment means guide the length of cordage about at least 40% of the rotating member perimeter.

In a first embodiment of the invention, the at least one rotating member of the furling system comprises a furling sail swivel for attachment to the head of a furling sail, with the swivel generally comprising a top body element, a bottom body element having a perimeter, the bottom body element rotatably connected to the top body element; and cordage attachment means on the bottom body element, the attachment means for guiding a length of cordage about a portion of the bottom body element perimeter.

In a second embodiment of the furling system of the invention, the rotating member comprises a rotating drum for attachment to a furling sail tack, the drum generally comprising a spool and a body, the body having cordage attachment means for guiding a length of cordage about at least a portion of the body.

In a most preferred embodiment of the furling sail system of the invention, the system comprises at least two rotating members: a rotating drum for attachment to a sail tack, and a rotating swivel for attachment to a sail head, each having cordage attachment means for guiding a length of cordage about at least a portion of the perimeter of the respective swivel or drum. In particular, this most preferred embodiment comprises a furling swivel for attachment to the furling sail head, the swivel having a top body element, a bottom body element rotatably connected to the top body element, the bottom body element having a perimeter, and having first cordage attachment means on the bottom body element for guiding a first length of cordage about a portion of the bottom body element. The preferred furling sail system further comprises a furling drum for attachment to the furling sail tack, the furling drum having a spool and a body connected thereto, the body having a perimeter, second cordage attachment means on the drum body, the second cordage attachment means for guiding the second length of cordage about a portion of the drum body perimeter. The drum and swivel may be connected to one another by the furling sail. The drum and swivel may also be connected by a foil that rotatably runs over a headstay.

The furling sail system of the present invention in its all of its various to embodiments solves all of the aforementioned problems in the prior art. In particular, the novel cordage attachment means allow for attachment of a sail without use of a tang, shackle, bracket, or other additional means. This substantially lowers the weight and dramatically improves the wind drag profile of the rotating member. Additionally, problems associated with bracket or clasp fatigue and failure are eliminated.

The furling sail system of the present invention also solves problems of the prior art related to load placed on rotating member bearing means. Because the sail is attached to the rotating member of the invention by guiding a length of cordage about a portion of the circumference of the member, the load is distributed about that circumference. This provides for substantially improved load distribution on the bearing means, resulting in less friction during rotation of the member and longer service life of the bearings. Also, because the rotating member of the invention does not require a tang for attaching the sail, problems associated with an increased bending moment are solved. These factors also advantageously allows for the furling sail system of the present invention to be constructed using smaller bearing means than those of the prior art, with resultant weight and wind drag advantages thereby realized.

The present invention further comprises a method for attaching a furling sail to at least one furling system rotating member, the sail having an eyelet, the furling system rotating member having a body with a perimeter, the method comprising the steps of passing a first end of a length of cordage through the sail eyelet, passing the cordage first end through cordage attachment means on the rotating member body, with the attachment means guiding the cordage over at least a portion of the lower body element perimeter, and finally attaching the cordage first end to the second end of the length of cordage. Preferably, the method of the invention comprises passing the first end of the length of cordage through cordage attachment means that comprise at least one channel.

The above brief description sets forth rather broadly the more important features and advantages of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining the embodiment of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

DETAILED DESCRIPTION

Figure 1:
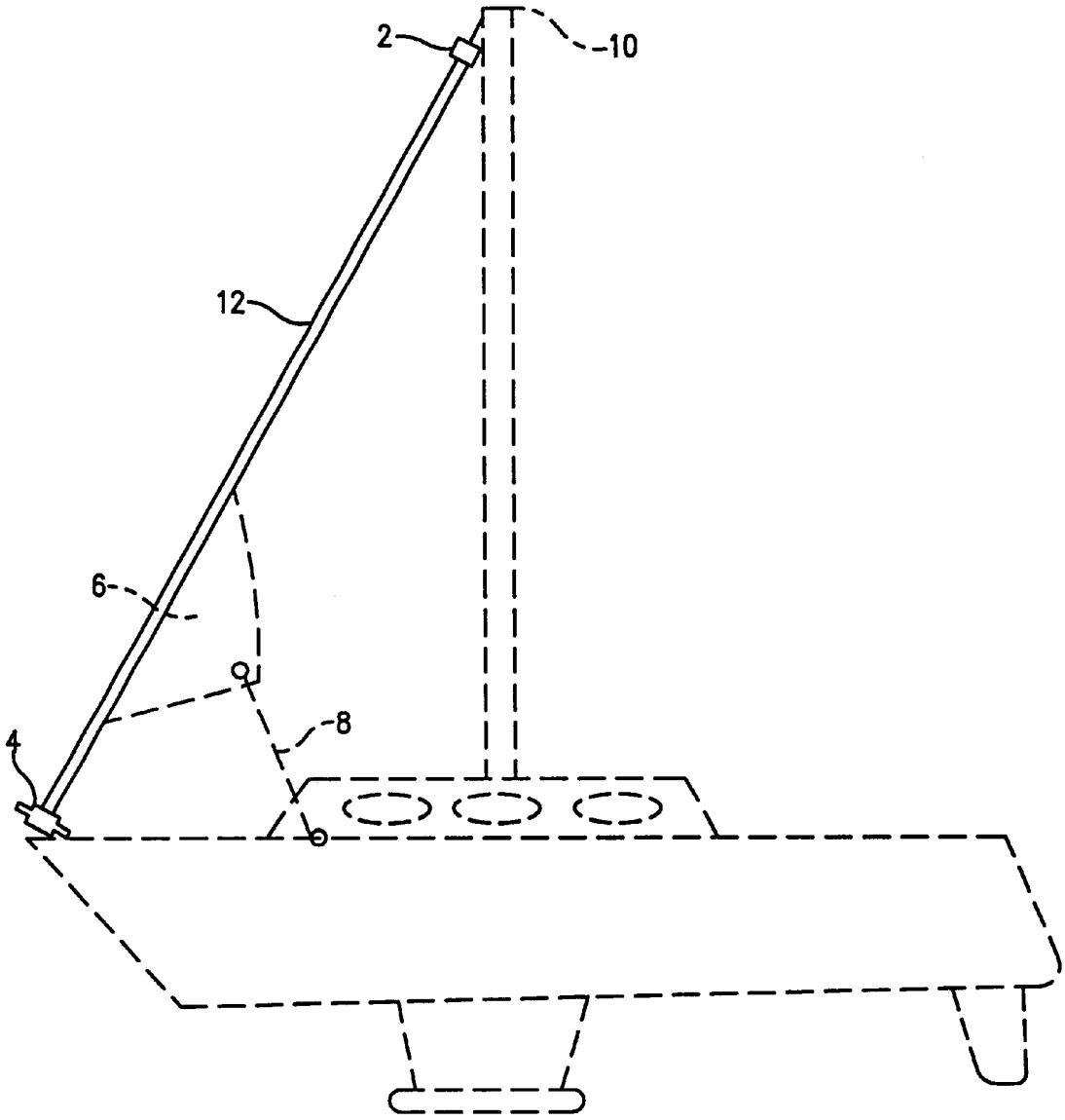
FIG. 1 PRIOR ART
FIG. 1 is an illustration of a furling sail system comprising a swivel and drum installed on a sailboat and attached to the head and tack, respectively, of a furling sail (boat and sail shown in dashed)
Figure 2:
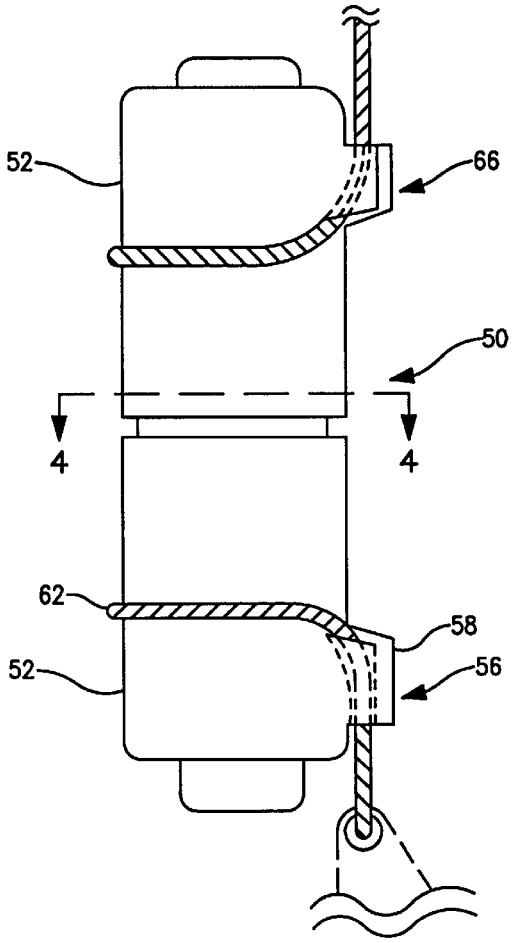
FIG. 2 is a side view of a first rotating member embodiment of the present invention comprising a swivel.
Figure 3:
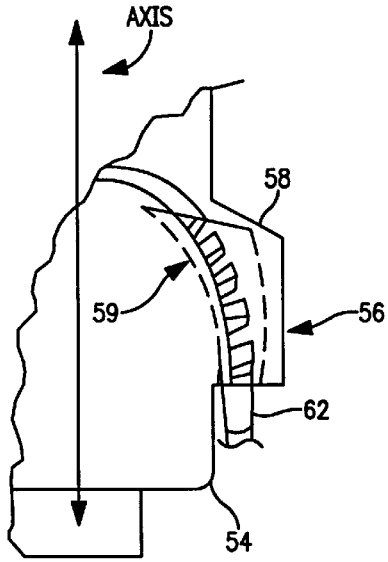
FIG. 3 is an expanded side view of a channel of the swivel of FIG. 2.
Figure 4:
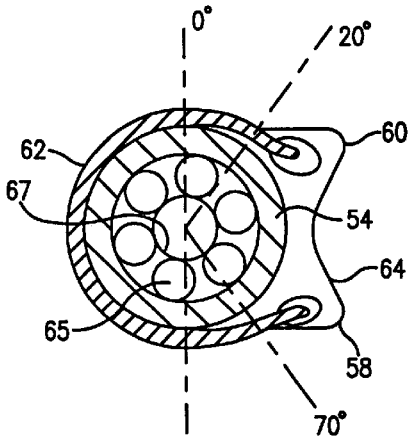
FIG. 4 is a cross-section of the swivel of FIG. 2, taken along the line 4—4 of FIG. 2.

Turning now to the drawings, FIGS. 2–4 illustrate a first embodiment of the furling sail system rotating member of the present invention. This first embodiment comprises rotating swivel 50 having top body element 52 rotatably attached to bottom body element 54. Bottom body element 54 further comprises cordage attachment means 56, which comprise a pair of channels 58 and 60 as illustrated in the cross section of FIG. 4 taken along the line 3—3 of FIG. 2. Channels 58 and 60 cooperate with one another whereby a length of cordage may be guided about a portion of the perimeter of bottom body element 54. The cordage 62 may then be used to attach a furling sail such as that illustrated in dashed line in FIG. 2. It is noted that as used herein, the term "cordage" is intended to refer to strapping in addition to rope, as well as other cordage means as are known in the art.

As best illustrated in FIG. 3, preferably channel 58 (and channel 60) have an arced inner path 59 (shown in dashed) that is angled to guide cordage 62 in a direction around the bottom element 54 perimeter. Arced inner path 59 serves to gradually redirect cordage 62 from a substantially vertical direction to a substantially horizontal direction for directing the cordage about a portion of the perimeter of bottom element 54 without any sharp bends. Sharp bends are disadvantageous in that they tend to wear on cordage and thereby shorten cordage service life. Further, sharp bends cause undesirable friction as the cordage is drawn through channel 58.

Referring once again to FIGS. 2 and 3, cordage attachment means 56 are constructed with a low, close to the surface profile that allows for an excellent wind drag profile. The cross sectional view of FIG. 3 further illustrates a preferred sloping cross element 64 that joins channels 58 and 60. The sloping shape of central cross element 64 provides advantageous strength characteristics with low weight and a low wind profile.

As is also evident from FIGS. 2–4, cordage attachment means 58 and 60 advantageously attach the cordage close to the surface of bottom body element 54. As discussed herein above, this lowers the bending moment that is present in prior art devices having a tang. Further, cordage attachment means 58 and 60 preferably guide the cordage about a portion of about at least 50% of the perimeter of bottom body element 64. As also discussed herein above, this is advantageous in that the load on bearings 65 is distributed over a much greater proportion than is possible with swivels of the prior art, allowing for construction of the swivel with smaller and lighter weight bearings. This provides valuable cost savings, weight reduction, and improved wind drag performance.

As illustrated in FIG. 4, cooperating channels 58 and 60 are located approximately between 20° and 70° on the substantially circular cross section of bottom body element 54. The cordage channels 58 and 60 will be preferably located such that cordage 62 passes around at least 40% of the perimeter of element 54, and more preferably around at least 50%, as illustrated in FIG. 4. It is noted that the cordage may be wrapped completely around the bottom body element perimeter if desired.

Distribution of the load over a significant portion of the perimeter of body element 54 as well as elimination of a tang based magnification of the bending moment results in substantially easier rotation of bottom body element 54, allows for increased service life of bearings 65 (that facilitate rotation of bottom body element 54), and allows for construction of a swivel using bearings that are smaller than possible with swivels of the prior art. This results in still further savings in weight, and for a narrower swivel than was possible in the prior art. It is noted that the general swivel configuration as illustrated in FIG. 4 showing bearings 65 between bottom boy element 54 and an inner stay channel 67 (through which a head-stay passes) is preferred only, and that as will be appreciated by those knowledgeable in the art many other particular swivel configurations may be practiced within the scope of the invention as claimed.

In this manner, the swivel of the present invention as illustrated in the embodiment of FIGS. 2–4 allows for attachment of a sail to the swivel lower body portion 54 with cordage only, and without requirement of a tang, shackle, bracket, or other similar elements. This realizes important advantages in weight, service life, ease of rotation, and wind profile. No furling sail swivel of the prior art provides such advantage.

The first furling sail system rotating member embodiment of FIG. 2 illustrates cordage attachment means 66 on swivel top body element 52 that are substantially identical to lower body attachment means 56. Such a construction is preferred. It is noted, however, that other embodiments of the invention do not comprise top body element 52 cordage attachment means that are substantially identical to lower body element means 56. In particular, as swivel top body element 52 is attached to the masthead or other stationary support, it does not rotate, and thus a reasonable wind profile may be achieved using cordage attachment means of the prior art, such as a shackle or bracket.

It is also noted that the swivel of the invention is practical for virtually any furling sail application because of the recent availability of very high strength, low diameter cordage, including cordage constructed of DuPont's Spectra fiber. In addition to such cordage, as noted herein the present invention may likewise be practiced using other forms of cordage, including but not limited to strapping.

Figure 6:
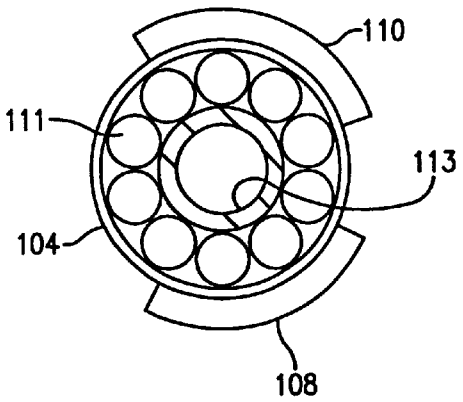
FIG. 6 is a cross-section of the swivel of FIG. 5, taken along the line 6—6 of FIG. 4.
Figure 5:
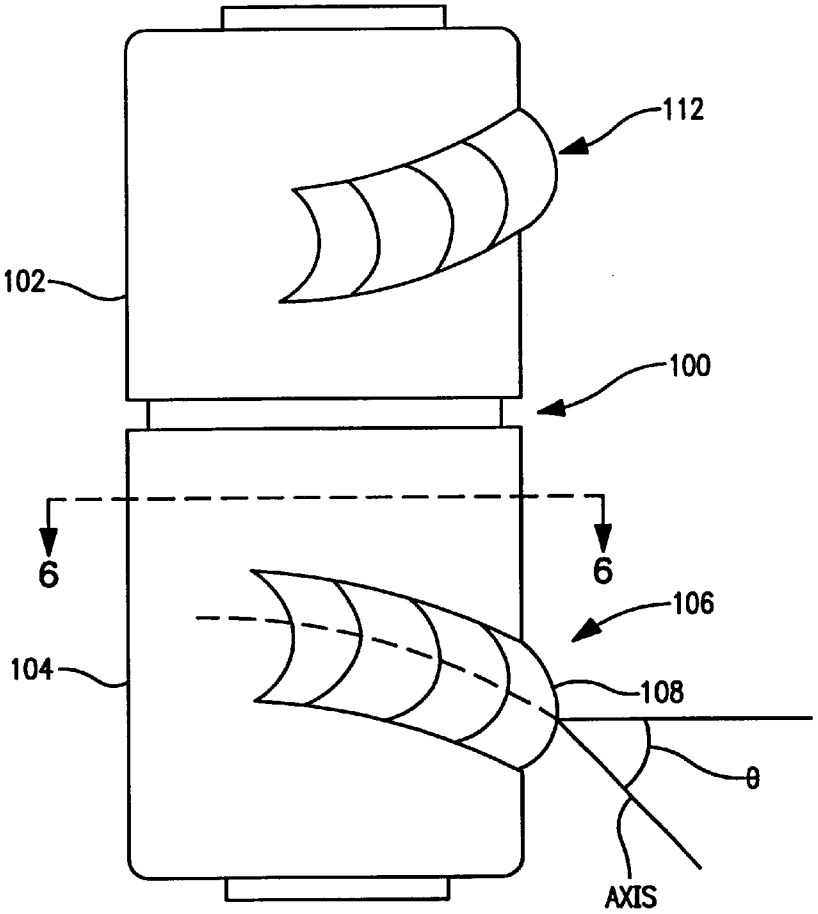
FIG. 5 is a side view of a second swivel embodiment of a furling sail system rotating member of the present invention.

FIGS. 5 and 6 illustrate a second embodiment of the furling sail system rotating member of the invention. Swivel 100 comprises top element 102 and bottom element 104 rotatably attached thereto. Cordage attachment means 106 comprise a pair of cooperating channels 108 and 110 through which a length of cordage may be passed and used to attach a sail. Channels 108 and 110 have a longitudinal axis that is preferably oriented outward from a central circumferential plane of swivel 100. It is noted that channels 108 and 110 may have a gradually curved length, as illustrated in FIG. 5. It is intended that "longitudinal axis" as used herein refer to an approximation of the direction of the curved length of the respective channel. The pair of cooperating channels on top body element 102 that comprise cordage attachment means 112 each have a longitudinal axis that is oriented outward from a central circumferential plane of swivel 100. The longitudinal axis of each channel may be curved and gradual, as generally illustrated by dashed axis AXIS. Preferably AXIS forms a downward angle of from about 20° to 80° is comprised, as illustrated by angle $\alpha$ of FIG. 5.

This preferred outward orientation advantageously directs the cordage downward towards the sail head to be attached from the bottom element 104 of swivel 100 while avoiding sharp bends or corners. Likewise, the cordage is directed upwards from top element 102 towards the masthead. As illustrated, channels 108 and 110 may be curved downward, so that the cordage exiting channel 108 is guided along a substantially planar path around a portion of swivel bottom body element 104 perimeter, into channel 110, and downward along the curved path of channel 110. Such configuration serves to avoid sharp bends and corners, which as discussed above are disadvantageous as they shorten cordage service life and increase friction.

Channels 108 and 110 are preferably integral with body element 104. As used herein, "integral" is intended to refer to a condition of being continuously constructed. Further, swivel 100 is preferably comprised of resin impregnated carbon fiber, fiberglass, or other high strength, low weight polymer material. Channels 108 and 110 may be formed during the molding process simultaneously with body element 104. Channels 108 and 110 may also be attached to element 104 through use of a joining agent such as an adhesive. In addition to the preferred carbon fiber construction, the rotating member of the invention may be formed of aluminum, steel, or other metal. Although such construction is typically heavier than the preferred plastic, carbon fiber, or fiberglass, it may be practical for very large boat applications.

FIG. 6 illustrates bearings 111 facilitating rotation of bottom body element 104 about inner head-stay channel 113 through which a non-rotating head stay passes. Channels 108 and 110 are preferably located so that the cordage will pass over at least 40%, more preferably at least 50%, and most preferably at least 75% of the perimeter of body element 104. It is noted that the portion of the perimeter of the body element 104 that the cordage passes over as it travels through channels 108 and 110 is included in this percentage. This is advantageous over swivels of the prior art for a number of reasons as discussed herein above. In particular, distribution of the load over a substantial portion of the swivel perimeter reduces friction associated with swivel rotation, and increase the service life of bearings 111. Elimination of a tang attachment point also eliminates the disadvantageous magnification of the bending moment tangs of the prior art produced.

As illustrated, cordage attachment means 112 on upper body element 102 are substantially identical to channels 108 and 110. As discussed above with reference to the swivel embodiment illustrated in FIGS. 2–4, substantially identical cordage attachment means are preferred to advantageously reduce weight and wind drag. Other embodiments of the swivel of the invention, however, may comprise cordage attachment means on swivel top body element 102 that are known in the prior art. As top element 102 remains substantially unrotating with reference to the boat masthead, advantages to be gained by the cordage attachment means of the invention may not be great as are available through incorporation of the attachment means on swivel bottom element 104.

Figure 8:
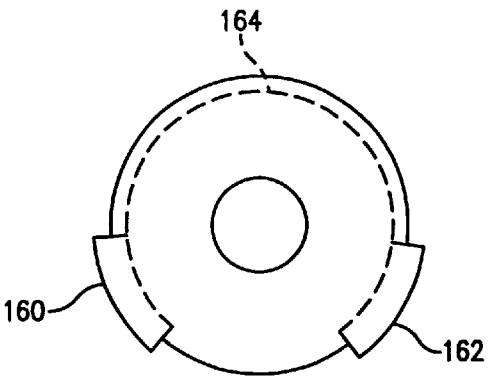
FIG. 8 is a cross section of the swivel of FIG. 7 taken along the line 8—8 of FIG. 7.
Figure 7:
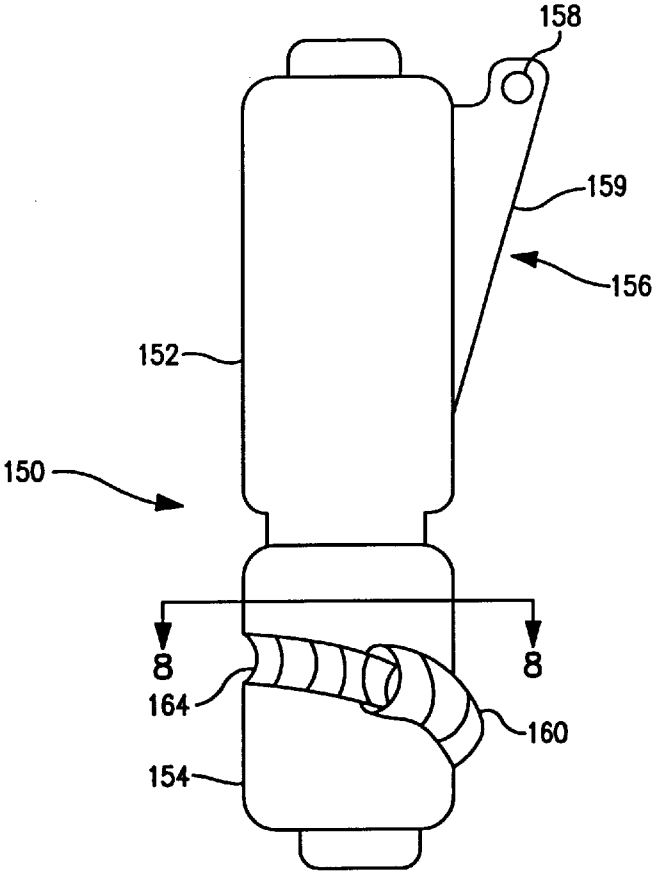
FIG. 7 is a side view of a third swivel embodiment of the furling sail system rotating member of the present invention.

As an example, reference is made to a third embodiment of a swivel of the invention illustrated in FIGS. 7 and 8. Swivel 150 comprises a top element 152 rotatably attached to a bottom element 154. Swivel top element 152 comprises cordage attachment means 156 which are generally known in the prior art. A passage 158 is provided proximate the upper edge of tang 159 for attachment to cordage, a shackle, bracket, or the like.

Swivel bottom element 154 cordage attachment means comprise a pair of cooperating channels 160 and 162. A substantially semicircular trough 164 is comprised between channels 160 and 162 to guide cordage from one passage to another along a desired path. Trough 164 also serves to further reduce the wind drag profile of swivel 150 when in use, as cordage passing around the perimeter of element 154 is partially sheltered below the outermost surface of element 154. Channels 160 and 162 may then have a lower profile closer to the surface of element 154.

As illustrated in FIGS. 7 and 8, the rotating member of the invention may comprise upper and lower body elements of different sizes and shapes. The upper and lower body elements may be under different amounts of load stress. In order to minimize overall weight, it may therefore be advantageous to construct one or the other of the swivel top and bottom elements of lesser size than the other as required to carry the load stress the particular element is under.

It is also noted that swivels need not be of the substantially circular shape as illustrated in the various embodiments of FIGS. 2–8. As will be appreciated by those knowledgeable in the art, the swivel of the invention may be comprised of other shapes. A slightly oval shape, by way of example and not limitation, may provide an advantageous wind drag profile. In addition, the various embodiments illustrated in FIGS. 2–8 are shown having a pair of cooperating channels for attaching cordage. The swivel of the invention could of course alternatively comprise a single channel for attaching cordage. As an example only, and not intended as a limitation, the embodiments illustrated could comprise a single channel spanning the distance covered by the cordage as it passes through the illustrated pair of channels.

Figure 10:
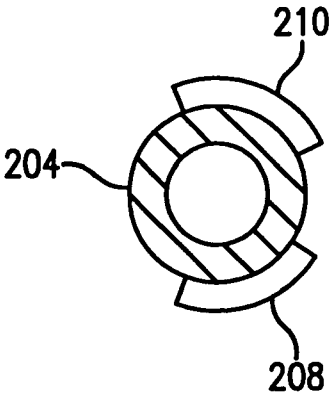
FIG. 10 is a cross section of the drum of FIG. 9 taken along the line 10—10 of that FIG.
Figure 9:
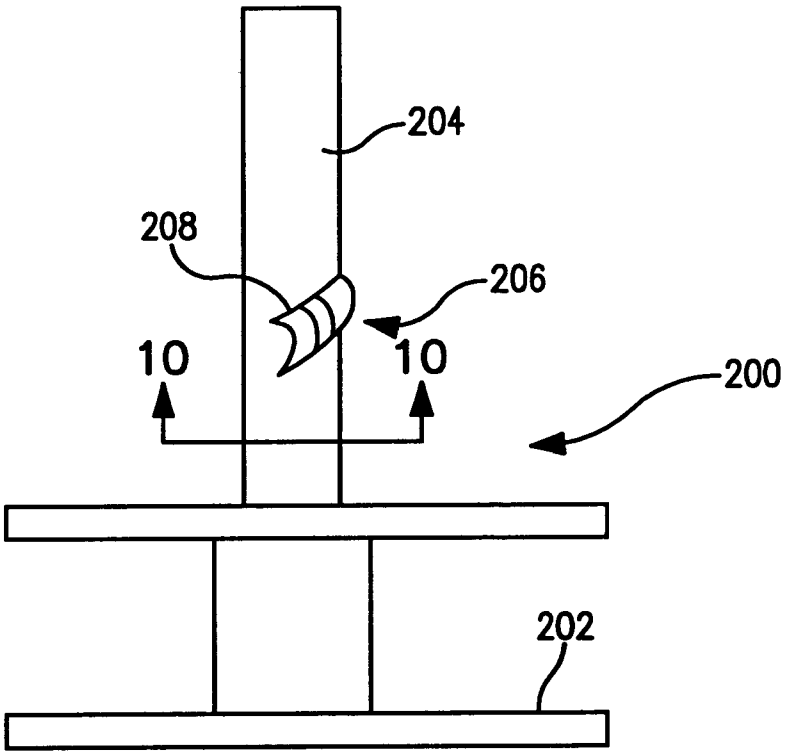
FIG. 9 is a side view of a drum embodiment of the furling sail system rotating member of the present invention.

FIGS. 9–10 illustrate yet another embodiment of the furling sail system rotating member of the invention. Furling sail rotating drum 200 comprises spool 202 and body 204. Body 204 and drum 200 rotate about a head-stay (not illustrated), and are for attachment to a furling sail tack (not illustrated). A furling line (not illustrated) is removably stored on spool 202, and may be used to spin the drum for retracting and deploying the furling sail. Cordage attachment means 206 are attached to body 204 for attaching a length of cordage thereto. Cordage attachment means 206 preferably comprise a pair of channels 208 and 210 for guiding the length of cordage about a portion of the perimeter of body 204. Channels 208 and 210 preferably have a longitudinal axis that is oriented outward from a central circumferential plane of body 204 for guiding the length of cordage to the furling sail tack.

As will be appreciated by those knowledgeable in the art, channels 208 and 210 are configured in substantially an identical manner as the cordage attachment means as described herein above with reference to the swivel rotating member embodiments of the invention illustrated in FIGS. 5–6 and 7–8. As will be appreciated by those knowledgeable in the art, the cordage attachment means of drum 200 also of course carry with them all of the advantages of the invention as discussed herein above with reference to the swivel embodiments of FIGS. 2–8.

It is noted that swivels and drums for attaching furling sails may comprise additional parts and components and remain within the scope of the claimed invention. As an example, swivels of the invention may comprise an additional sail attachment point for attaching to the foil. This attachment point may likewise comprise cordage attachment means as described and claimed herein.

In a most preferred embodiment of the furling sail system of the invention, the furling system comprises both a swivel and a drum as described herein. This most preferred embodiment of the invention thereby comprises two rotating members, each having cordage attachment means comprising at least a channel for passing a length of cordage. The invention as claimed may of course be practiced, however, using only a swivel embodiment or only a drum embodiment.

The present invention further comprises a method for attaching a furling sail to a furling sail system rotating member with a length of cordage, the sail having an eyelet and the rotating member having a perimeter. The steps of the method of the invention generally comprise passing a the length of cordage through the sail eyelet, passing the length of cordage through cordage attachment means on the rotating member, passing the cordage along at least a portion of the rotating member perimeter, and closing the length of cordage by attaching its two ends to one another. The cordage is preferably passed about at least 40%, more preferably at least 50%, and most preferably at least 70% of the perimeter of the rotating member. It is noted that as used herein, the term "closing the length of cordage" refers to a step of forming a loop by attaching the length of cordage's ends to one another. This could be accomplished, by way of example only, by tying a knot with the two ends of a length of rope, or by sewing together the two ends of a length of strapping.

Through the method of the invention, the sail is attached to the furling system rotating member without use of brackets, clasps, or other disadvantageous parts. Important advantages are achieved as will be appreciated by those knowledgeable in the art in light of the discussion made herein with regards to the advantages of the apparatus of the invention.

Preferably, the method of the invention is practiced using a rotating member having cordage attachment means as described above herein with reference to the swivel and drum embodiments of the invention. In addition, the method of the invention is preferably practiced using high strength, low stretch synthetic cordage comprised of polypropylene or polyester fibers. An example of such cordage are those manufactured using DuPont's Spectra fiber.

The advantages of the disclosed invention are thus attained in an economical, practical, and facile manner. While preferred embodiments and example configurations have been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A furling sail system for deploying and storing a furling sail; the system for connecting to a sail with a length of cordage; the system comprising:

a) at least a rotating member for attachment to the furling sail; said rotating member having a body with a perimeter; and b) cordage attachment means on said rotating member; said cordage attachment means for guiding the length of cordage about at least a portion of said rotating member perimeter.

2. A furling sail system as in claim 1, wherein said attachment means is for guiding the length of cordage around at least 40% of said rotating member perimeter.

3. A furling sail system as in claim 1, wherein said attachment means is for guiding the length of cordage around at least 50% of said rotating member element perimeter.

4. A furling sail system as in claim 1, wherein said cordage attachment means comprise at least one channel for passing the length of cordage through.

5. A furling sail system as in claim 4, wherein said attachment means comprise a pair of channels, each of said pair of channels cooperating with one another whereby the length of cordage may pass through one of said pair of channels, pass around a portion of said lower body element perimeter and through the other of said pair of channels.

6. A furling sail system as in claim 5, wherein said at least one rotating member has a central circumferential plane, and wherein each of said pair of channels have a longitudinal axis, and wherein said longitudinal axis is oriented outward from said central circumferential plane.

7. A furling sail system as in claim 1, wherein said at least one rotating member and cordage attachment means are comprised of resin reinforced carbon fiber.

8. A furling sail system as in claim 1, wherein said at least one rotating member comprises a rotating swivel for attachment to a furling sail head, said swivel comprising;

a) an upper body element; and b) a lower body element rotatably connected to said upper body element; said lower body element having a perimeter; said lower body element having said cordage attachment means for guiding a length of cordage about a portion of said lower body element perimeter.

9. A furling sail system as in claim 8, wherein said top body element having a perimeter, and wherein said swivel further comprises:

a) second cordage attachment means on said swivel top body element, said second attachment means for guiding the length of cordage about a portion of said top body element perimeter.

10. A furling sail system as in claim 9 wherein said second attachment means comprise a pair of cooperating channels for guiding the length of cordage.

11. A furling sail system as in claim 1, wherein said at least a rotating member comprises a rotating drum for connection to a furling sail tack.

12. A furling sail system as in claim 11, wherein said rotating drum comprises:

a) a body, said body having a spool connected thereto, said body having a perimeter; and b) said cordage attachment means on said body above said spool, said cordage attachment means comprising at least a channel for guiding the length of cordage about a portion of said body perimeter.

13. A furling sail system as in claim 12, wherein said at least a channel comprises a pair of channels, said pair of channels cooperating with one another for passing the length of cordage about a portion of said body perimeter.

14. A furling sail system as in claim 12, wherein said at least a channel guides the length of cordage about at least 50% of said body perimeter.

15. A furling sail system as in claim 12, wherein said at least a channel having a longitudinal axis, and wherein said drum body having a central centrifugal plane, said longitudinal axis oriented outward from said central centrifugal plane.

16. A furling sail swivel for attachment to a furling sail head with a length of cordage; the system comprising:

a) a top body element;

b) a bottom body element rotatably connected to said top body element, having a perimeter, having a central centrifugal plane; and c) a pair of channels on said bottom body element for attaching the length of cordage to the swivel, each of said pair of channels cooperating with one another whereby the length of cordage may be passed through one of said pair of channels, around a portion of said bottom body element perimeter, and through the other of said pair of channels; each said pair of channels having a longitudinal axis, said longitudinal axis oriented at an angle downward from said bottom body element central centrifugal plane.

17. A furling sail drum for attachment to a furling sail tack with a length of cordage; the system comprising:

a) a spool;

b) a body connected to said spool having a perimeter, having a central centrifugal plane; and c) cordage attachment means comprising a pair of channels on said body for attaching the length of cordage to the drum, each of said pair of channels cooperating with one another whereby the length of cordage may be passed through one of said pair of channels, around a portion of said body perimeter, and through the other of said pair of channels; each of said pair of channels having a longitudinal axis, said longitudinal axis oriented at an angle outward from said body central centrifugal plane.

18. A furling sail system for connection to a furling sail head with a first length of cordage and for connection to a furling sail tack with a second length of cordage; the system comprising:

a) a furling swivel for attaching the furling sail head, said swivel having:

i) a top body element;

ii) a bottom body element rotatably connected to said top body element; said bottom body element having a perimeter;

iii) first cordage attachment means on said bottom body element, said first cordage attachment means for guiding the first length of cordage about a portion of said bottom body element perimeter; and b) a rotating drum for attaching the furling sail tack, said drum connected to said swivel by the furling sail; said drum having:

i) a spool and a body, said body connected to said spool; said body having a perimeter;

ii) second cordage attachment means on said drum body; said second cordage attachment means for guiding the second length of cordage about a portion of said body perimeter.

19. A furling sail system as in claim 18, wherein said first cordage attachment means comprise at least a passage for guiding the first length of cordage about said portion of said bottom body element perimeter; and wherein said second cordage attachment means comprise at least a passage for guiding the second length of cordage about said portion of said drum body perimeter.

20. A method for attaching a furling sail to a furling sail system rotating member with a length of cordage, the sail having an eyelet; the rotating member having a perimeter; the method comprising the steps of:

a) passing the length of cordage through the sail eyelet; passing the length of cordage through cordage attachment means on the furling sail system rotating member, and closing the length of cordage by attaching its two ends to one another.

21. A method for attaching a furling sail to a furling sail rotating member as in claim 20, wherein the rotating member having a perimeter, and wherein said step of passing the length of cordage through cordage attachment means further comprises passing the length of cordage around at least a portion of said lower body element perimeter.

22. A method for attaching a furling sail to a furling sail rotating member as in claim 21, wherein said cordage attachment means comprise at least a channel through which the cordage passes for guiding the cordage about said portion of said perimeter.

23. A method for attaching a furling sail to a swivel as in claim 22, wherein said attachment means comprises a pair of channels, said pair of channels cooperating with one another whereby said step of passing the length of cordage through said attachment means comprises passing the length of cordage through one of said pair of channels, passing the length of cordage about a portion of said rotating member perimeter, and passing the length of cordage through the other of said pair of channels.

24. A method for attaching a furling sail to a furling sail system rotating member with a length of cordage, the sail having an eyelet, the rotating member having a perimeter; the method comprising the steps of:

a) passing the length of cordage through the sail eyelet; passing the length of cordage through a first channel on the furling sail system rotating member, passing the length of cordage about a portion of the rotating member perimeter, passing the length of cordage through a second channel on the rotating member; and b) closing the length of cordage by attaching its two ends to one another.

* * * * *